US011793339B1

(12) United States Patent
Waghalter

(10) Patent No.: US 11,793,339 B1
(45) Date of Patent: Oct. 24, 2023

(54) GARMENT RACK COVER

(71) Applicant: Elizabeth Arlene Waghalter, Kyle, TX (US)

(72) Inventor: Elizabeth Arlene Waghalter, Kyle, TX (US)

( * ) Notice: Subject to any disclaimer, the term of this patent is extended or adjusted under 35 U.S.C. 154(b) by 0 days.

(21) Appl. No.: 18/079,970

(22) Filed: Dec. 13, 2022

(51) Int. Cl.
*A47G 25/54* (2006.01)
*A47G 25/06* (2006.01)

(52) U.S. Cl.
CPC ..... *A47G 25/54* (2013.01); *A47G 25/0664* (2013.01)

(58) Field of Classification Search
CPC .... A47G 25/54; A47G 25/06; A47G 25/0664; A47G 25/0671; A47G 25/0685; A47G 25/0692
See application file for complete search history.

(56) References Cited

U.S. PATENT DOCUMENTS 942,580 A * 12/1909 McGregor et al. .... B65D 19/12 211/180
968,352 A * 8/1910 Hermann ..... B65D 19/12 312/3
1,777,911 A * 10/1930 Case ..... A47G 25/54 211/180
2,016,520 A * 10/1935 Short ..... A45C 7/0077 190/122
2,899,081 A * 8/1959 Meyers ..... A47G 25/54 211/180
5,697,508 A * 12/1997 Rifkin ..... B65G 9/002 211/124
2002/0115905 A1* 8/2002 August ..... A47C 21/00 600/27
2007/0068980 A1* 3/2007 Bell ..... A47G 25/54 223/85
2007/0193970 A1* 8/2007 Carington ..... A47G 25/06 211/105.1
2013/0264232 A1* 10/2013 Wang ..... A47G 25/54 206/289
2018/0132644 A1* 5/2018 Caruso ..... A47G 25/06

* cited by examiner

*Primary Examiner* — Ismael Izaguirre

(57) ABSTRACT

Fabric cover for a garment rack, its components, their relationship to each other, and materials used for manufacturing the same are herein disclosed. The cover generally includes a panel with two sides, with a plurality of connectors affixed to one side to be secured to the garment rack bar, and a plurality of connectors affixed to the vertical portion edge of both sides of the panel.

13 Claims, 4 Drawing Sheets

GARMENT RACK COVER

FIELD

The present technology pertains to the protection of garments and garment racks, and more specifically a covering used to protect the garments from external elements and/or for the safe transportation of garments and garment racks alike.

BACKGROUND

The garment industry is a multi-billion-dollar industry comprised of numerous types of garments and garment racks used to transport garments. Garments must be protected from damage when shipped to locations including but not limited to department stores, where they spend the majority of their shelf life stagnant indoors until purchased by an end consumer.

However, garments are usually reused and transported from different locations, throughout their useful life, with only single-use shrink wrap, thus exposing the garments to natural and/or manmade elements including but not limited to food, dirt, debris, rain, wind, dust, sleet, snow and sun. This can cause damage to these costly items which are needed to complete a specific project.

Current alternative products on the market, intended for the same protective purpose, utilize certain features intended to affix the covers to the garment racks. Examples of such features include Velcro or zippers. However, these features can cause unwanted damage to the garments. Garments may become damaged if entrapped in the zipper, or unintended and repeated adherence of Velcro to the garments may cause unwanted damage.

The benefits of this invention's design and functionality over other comparable inventions include the easy retrieval of garments from the rack when the garment rack cover is in the "open" position, the protection of the garments from outdoor elements via the durable material comprising the garment rack cover, and the direct attachment of the garment rack cover to the rack through the use of a first plurality of connectors secured to the horizontal bar of a garment rack and a second plurality of connectors along the vertical portion edge of the panel enabling the garment rack cover to be securely tied on each side of the garment rack.

Therefore, a need exists to protect these items from damage caused by the aforementioned natural and manmade elements as well as damage caused by other means of protecting the garments, so as to ensure the integrity and usefulness of these garments throughout the necessary timeframe without replacement or need for repair.

SUMMARY

In some embodiments, a fabric panel for a clothing rack can be provided, having affixed to it a first plurality of connectors and a second plurality of connectors.

In some embodiments, the fabric panel can include one or more panel sections wherein there is a first side coupled to a second side of the panel.

In some embodiments, the fabric panel can include a plurality of connectors which are affixed to the first side of the panel in a way that enables them to be secured to a horizontal support bar of a garment rack. These extensions, once secured, enable for the second side of the panel to extent downwardly by a specified length.

In some embodiments the panel section can include a second plurality of connectors affixed to the vertical portion edge of the panel, enabling the second plurality of connectors to be coupled together.

In some embodiments the panel section can include, wherein upon securing the connectors, the opposing sides of the panel extend downwardly a specified length, ensuring that the contents of the garment rack (e.g., clothes, etc.) are covered.

In some embodiments, material that may be used for the cover is ripstop nylon, or any other reusable, washable and durable fabric.

In some embodiments, a fabric cover can include a panel having a first side coupled to a second side. The fabric cover can also include a first plurality of connectors coupled along a portion of the panel where the first side and second side are coupled, wherein the first plurality of connectors are configured to secure the panel to a horizontal support bar of a garment rack. The fabric cover can also include a second plurality of connectors coupled along each vertical portion edge of the first side and second side of the panel, wherein the second plurality of connectors are configured to be coupled together to at least secure the first side to the second side.

In some embodiments, the second plurality of connectors cam extend down each vertical portion edge of the first side and second side a predetermined length such that a connector on the first side is aligned with a connector on the second side.

In some embodiments, the connectors of the first side and the second side are connected and contents of the garment rack are covered.

In some embodiments, the first and second plurality of connectors comprise at least one of: snaps, rivets, buttons, clips, or tying.

In some embodiments, the first side and second side are of equidistant length.

In some embodiments the first side and second side are of different lengths and the second side is a longer side than the first side and is configured to wrap around to couple to the first side via one or more additional connectors.

BRIEF DESCRIPTION OF DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases, it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions when the information in this patent is combined with available information and technology.

Various ranges and/or numerical limitations may be expressly stated below. It should be recognized that unless stated otherwise, it is intended that endpoints are to be interchangeable. Further, any ranges include iterative ranges of like magnitude falling within the expressly stated ranges or limitations.

In general, a garment rack cover and the methods of manufacturing a garment rack cover are herein disclosed. The garment rack cover generally is designed to cover industrial garment racks but is not, nor should not, be limited to only industrial garment racks.

The garment rack cover generally includes a panel(s) of fabric having a first plurality of connectors affixed and located on the panel, enabling the connectors to be secured to the horizontal support bar of a garment rack. Once the connectors are secured to the support bar, the opposing sides of the panels extend downwardly a specified length, covering the contents of the garment rack.

Figure 1:
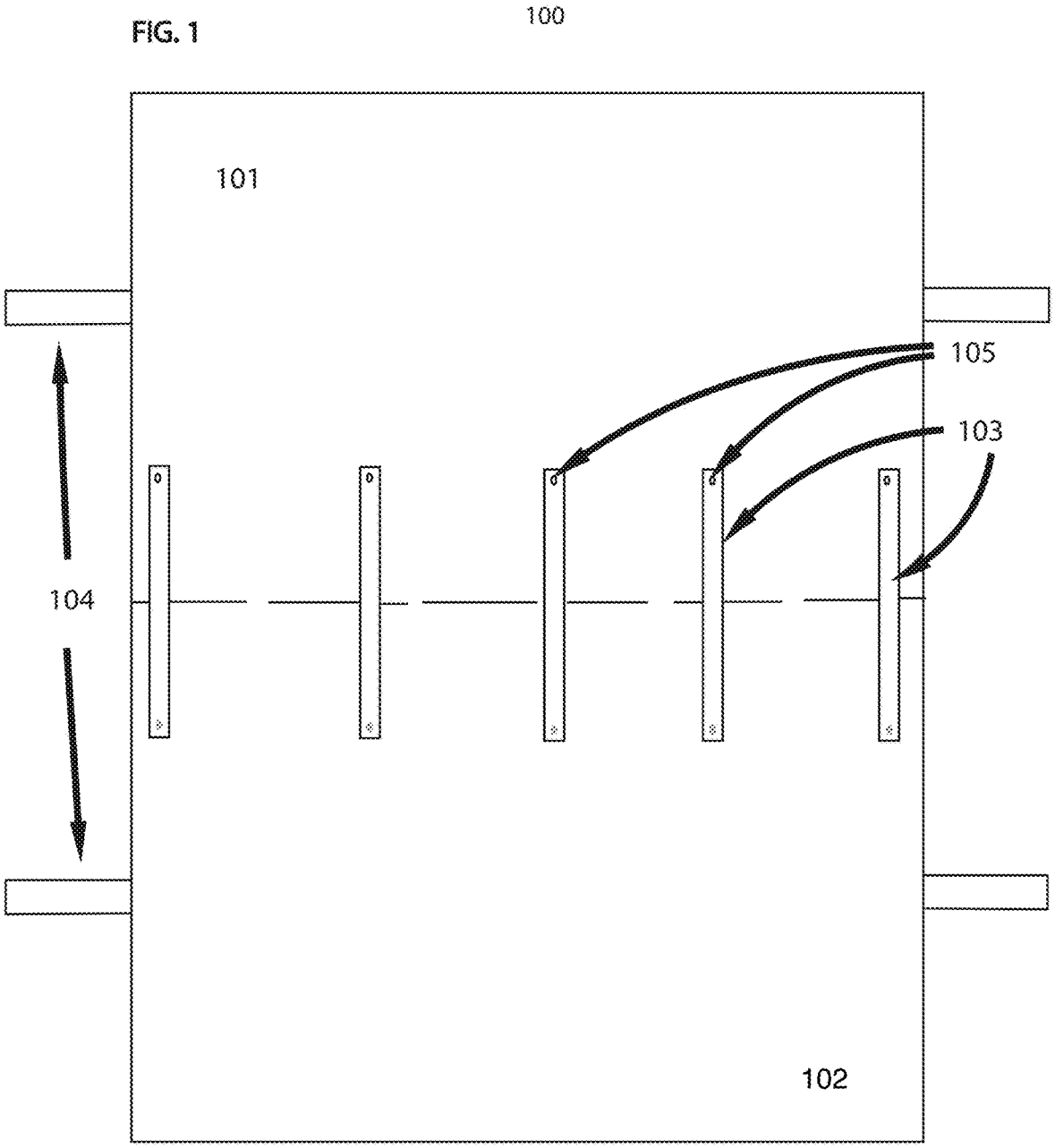
FIG. 1 illustrates a topside view of an example garment rack cover not in use.

FIG. 1 illustrates a topside view of garment rack cover 100. Garment rack cover 100 includes first panel 101 and second panel 102. First panel 101 and second panel 102 are coupled together, opposite one another forming cover 100. In some embodiment, cover 100 is a single panel. In other embodiment, cover 100 includes multiple panels. Garment rack cover 100 can include multiple storage apparatuses, for example, pockets, etc. The storage apparatuses (not shown) can be attached to cover 100 in a variety of ways, including but not limited to sewing, buttons, clasps, etc. The storage apparatuses (not shown) can include one or more mechanisms for closing the apparatuses, preventing items from falling out of the storage apparatuses.

A first plurality of connectors 103 can be affixed at or proximate to the coupling of the first panel and second panel. Connectors 103 can be affixed at predetermined distances, for example, the predetermined distances can be equidistant from one another or varied in length. Connectors 103 can be attached to cover 100 in a variety of ways, including but not limited to sewing, buttons, clasps, etc. In some embodiments, connectors 103 can be affixed at half of the total length of the cover, or at a length that allows the sides of each panel to cover a garment rack at different lengths on either side, for example, so a longer length can be wrapped around and connected to the other side. Connectors 103 can be of a minimum length such that they can be wrapped around a support rod of a garment rack. Connectors 103 can be made of one or multiple fabrics, chains, ropes, wire, plastic, hooks, etc. Connectors 103 can be secured to the support rod via securing mechanisms 105.

Securing mechanisms 105 can include but are not limited to snaps, rivets, buttons, clips, tying, etc. Connectors 103 can include a singular securing mechanism 105 or a multitude of securing mechanisms. Securing mechanisms 105 can be attached to connectors 103 at the ends of connectors 103. In some examples, securing mechanism 105 can be located at different positions along connectors 103 to accommodate different fittings around different garment rack support rods.

Cover 100 also includes a second plurality of connectors 104 affixed to the vertical edge of the cover 100 perpendicular to the connectors 103. Second plurality of connectors 104 can be affixed at predetermined distances. For example, the predetermined distances can be equidistant from one another or varied in length. Connectors 104 can be attached to cover 100 in a variety of ways, including but not limited to sewing, buttons, clasps, etc. Connectors 104 can be made of one or multiple fabrics, chains, ropes, wire, plastic, hooks, etc. The securing mechanism affixed to connectors 104 can have the same attachment mechanism as connectors 103 or another attachment mechanism that includes but is not limited to snaps, rivets, buttons, clips, tying, etc. Connectors 104 can include a singular securing mechanism or a multitude of securing mechanisms. Securing mechanisms can be attached to connectors 104 at the ends of connectors 104. In some examples, securing mechanism can be located in different positions along connectors 104 to accommodate different variations of tautness.

Figure 2:
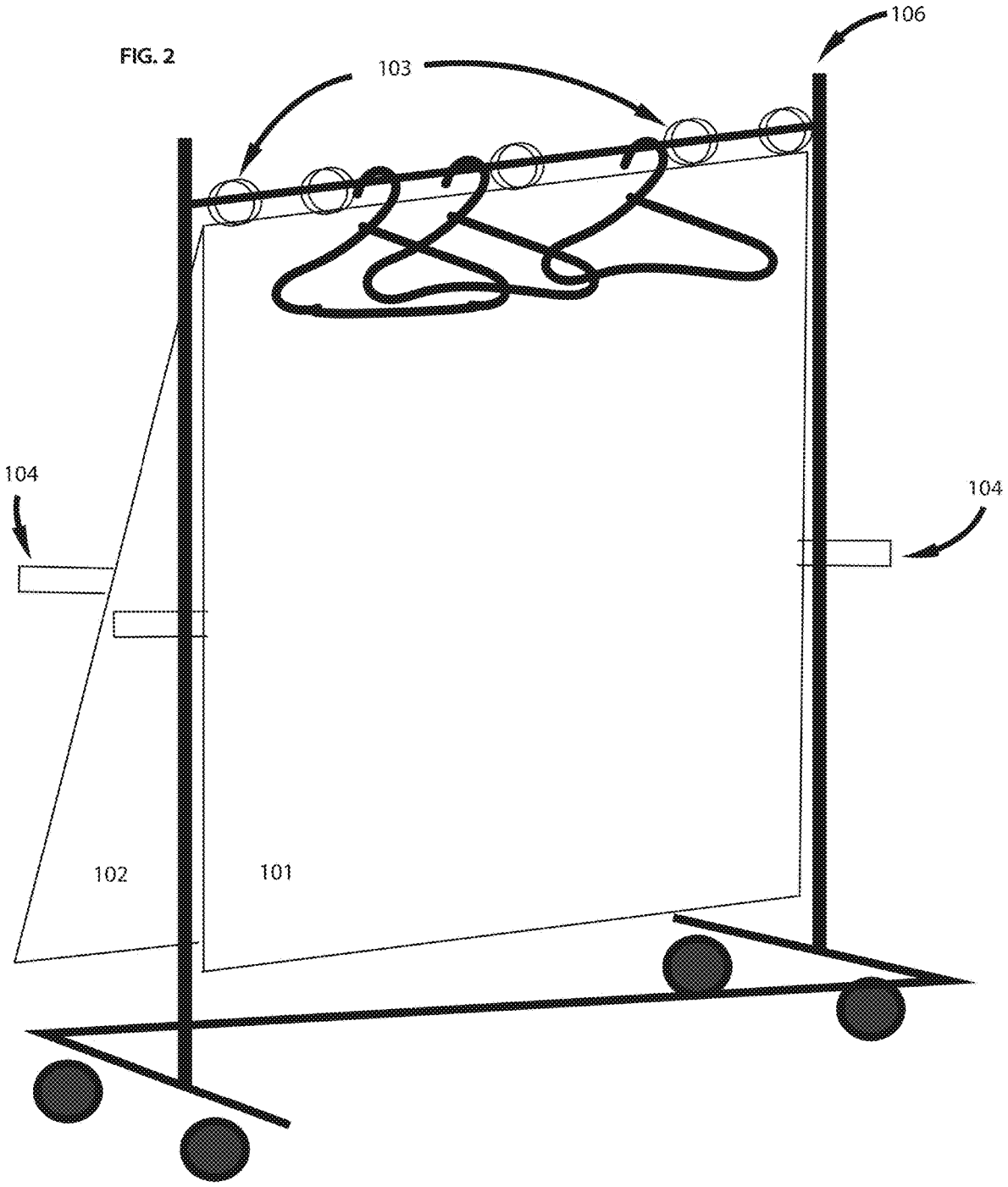
FIG. 2 illustrates a side view of the example garment rack cover in an open position.

FIG. 2 illustrates a side view of the garment rack cover affixed to garment rack. As shown, connectors 103 have been affixed to the horizontal support rod of garment rack 106. In some embodiments, Connectors 103 can be hidden from view, for example, connectors 103 could be affixed the interior of cover 100, such that they would be hidden from view when attached to rack 106. Once connectors 103 have been affixed to rack 106, panels 101 and 102 hang down rack 106. In some embodiments, panels 101 and 102, can be of equal lengths (as shown in FIG. 2). In other embodiments, panels 101 and 102 can be of different lengths.

Figure 4:
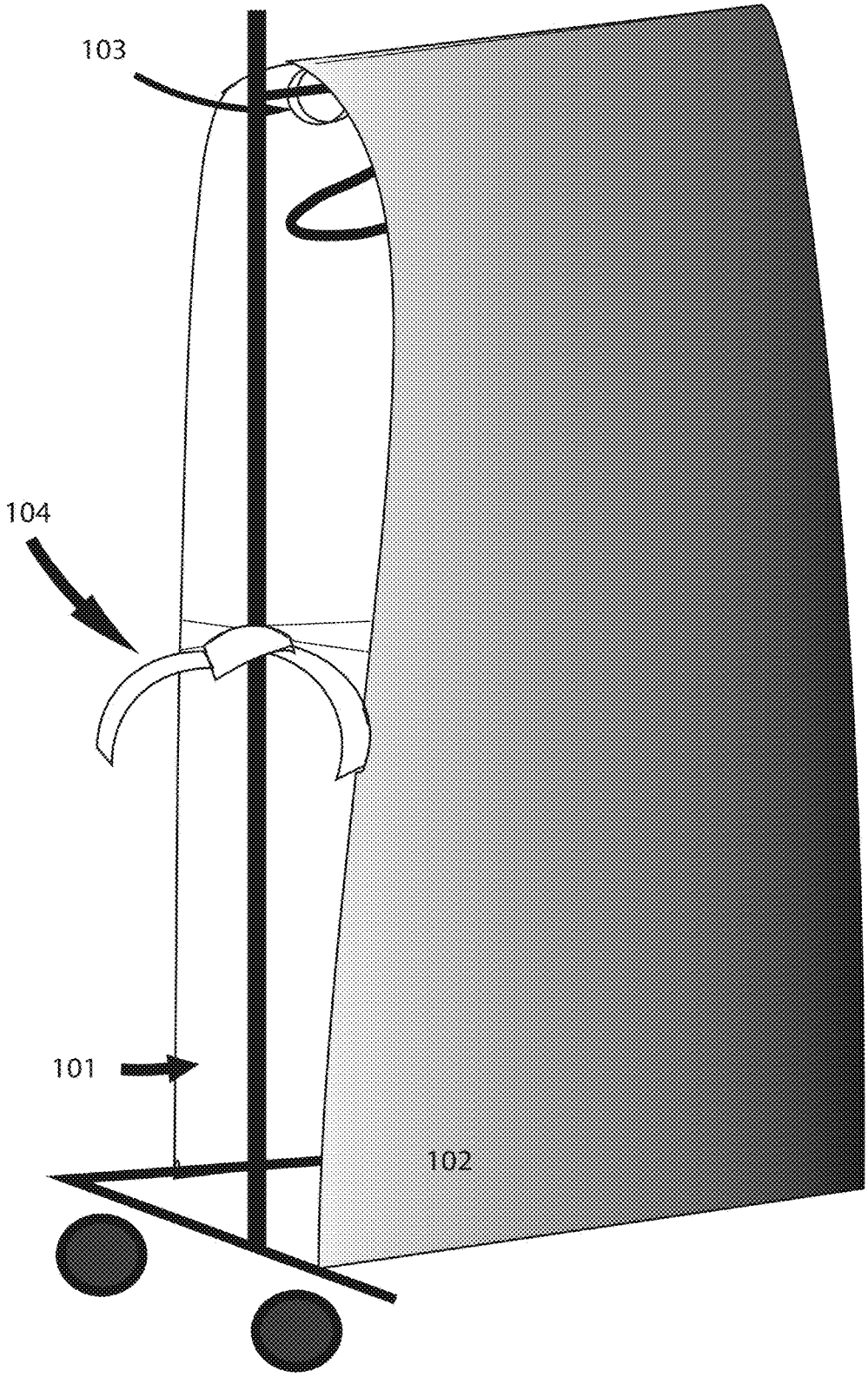
FIG. 4 illustrates a side view of the example garment rack cover in a closed position.

FIG. 2 further illustrates the garment rack cover 100 in an "open" position, allowing for clothing to be retrieved from or hung upon the garment rack 106 by placing or removing hangers against the first side 101. FIG. 4 illustrates the garment rack cover 100 in a "closed" position, not allowing for clothing to be retrieved.

Figure 3:
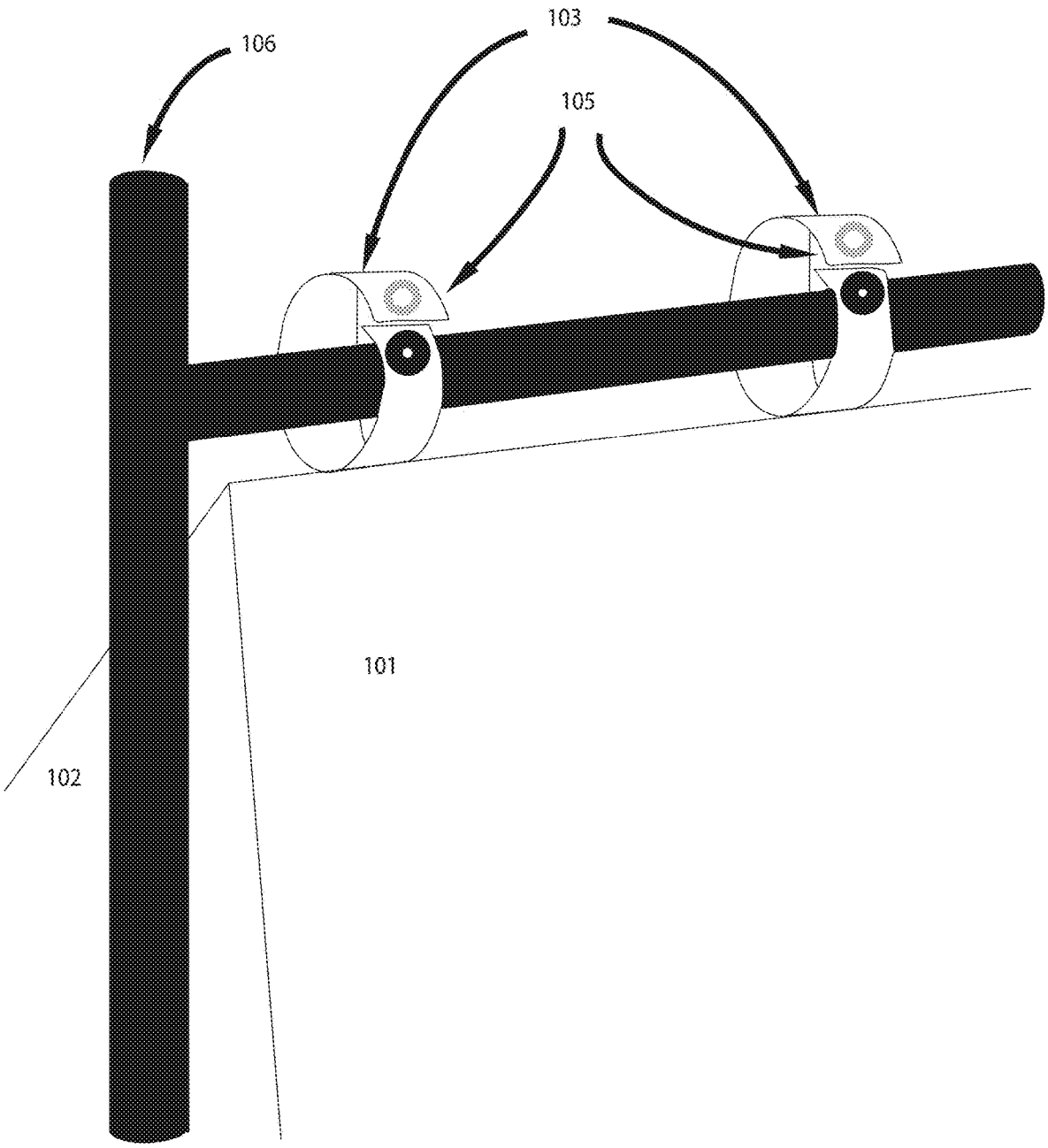
FIG. 3 illustrates a closer view of an example of plurality of connectors secured to the horizontal bar of a garment rack.

FIG. 3. illustrates an exploded view of connectors 103 about to be secured to the horizontal bar of garment rack 106 via securing mechanisms 105. Securing mechanisms 105 can include but are not limited to snaps, buttons, rivets, buttons, etc. In other embodiments, securing mechanisms 105 could include a snap on one side of the first plurality of connectors 103, and a multitude of corresponding snaps on the opposite side of the connectors 103, to allow the plurality of connectors 103 to accommodate different sized support rod circumferences.

FIG. 4 illustrates a side view of the garment rack cover, in a "closed" position. In the "closed" position, cover 100 protects the garments hung on the garment rack. The garment rack cover may be "closed" by connecting the plurality of connectors 104 from each opposing panel that extend downwards 101 and 102. The plurality of connectors 104 can be connected by tying the connectors together (as is illustrated in FIG. 4) or by using a securing mechanism including, but not limited to, snaps, buttons, rivets, buttons, etc. In some embodiments, there is no gap between panels 101 and 102. In other embodiments, there can be variety of different gap sizes, for example, to provide access to the garments in the closed position.

While the foregoing is directed to embodiments of the present invention, other and further embodiments of the invention may be devised without departing from the basic scope thereof and the scope thereof is determined by the claims that follow.

What is claimed is:

1. A fabric cover, comprising:

a panel including a first side coupled to a second side;

a first plurality of connectors coupled along a portion of the panel where the first side and second side are coupled, wherein the first plurality of connectors are configured to secure the panel to a horizontal support bar of a garment rack; and a second plurality of connectors coupled along each vertical portion edge of the first side and second side of the panel, wherein the second plurality of connectors are configured to be coupled together to at least secure the first side to the second side, wherein the first side and second side are of different lengths.

2. The fabric cover of claim 1, wherein the panel is comprised of a reusable fabric.

3. The fabric cover of claim 1, wherein the second plurality of connectors, extend down each vertical portion edge of the first side and second side a predetermined length such that a connector on the first side is aligned with a connector on the second side.

4. The fabric cover of claim 3, wherein connectors of the first side and the second side are connected, contents of the garment rack are covered.

5. The fabric cover of claim 1, wherein the first or the second plurality of connectors comprise snaps.

6. The fabric cover of claim 1, wherein the first side and second side are of equidistant length.

7. The fabric cover of claim 1, wherein the second side is a longer side than the first side and is configured to wrap around to couple to the first side via one or more additional connectors.

8. The fabric cover of claim 1, wherein the panel is comprised of a washable fabric.

9. The fabric cover of claim 1, wherein the panel is comprised of a durable fabric.

10. The fabric cover of claim 1, wherein the first or the second plurality of connectors comprise rivets.

11. The fabric cover of claim 1, wherein the first or the second plurality of connectors comprise buttons.

12. The fabric cover of claim 1, wherein the first or the second plurality of connectors comprise clips.

13. The fabric cover of claim 1, wherein the first or the second plurality of connectors comprise ties.

* * * * *